US007610956B2

(12) United States Patent
Farquharson et al.

(10) Patent No.: US 7,610,956 B2
(45) Date of Patent: Nov. 3, 2009

(54) WELLHEAD ASSEMBLY FOR HYDRAULIC PUMPING SYSTEM

(75) Inventors: Keith David Farquharson, Edmonton (CA); Gregory Wayne Allen, Spruce Grove (CA); Cuong Chi Vuong, Edmonton (CA); Gregg John Lacusta, Lloydminster (CA)

(73) Assignee: Stream-Flo Industries Ltd., Edmonton (CA)

( * ) Notice: Subject to any disclaimer, the term of this patent is extended or adjusted under 35 U.S.C. 154(b) by 278 days.

(21) Appl. No.: 11/621,524

(22) Filed: Jan. 9, 2007

(65) Prior Publication Data

US 2007/0193735 A1 Aug. 23, 2007

Related U.S. Application Data

(60) Provisional application No. 60/804,521, filed on Jun. 12, 2006, provisional application No. 60/757,833, filed on Jan. 9, 2006.

(51) Int. Cl.
*E21B 19/00* (2006.01)

(52) U.S. Cl. ..... 166/86.1; 166/88.4

(58) Field of Classification Search ..... 166/368, 166/86.1, 88.1, 88.4, 75.14
See application file for complete search history.

(56) References Cited

U.S. PATENT DOCUMENTS

| | | | | |
|---|---|---|---|---|
| 1,001,282 | A | 8/1911 | Kimber | |
| 4,305,461 | A | 12/1981 | Meyer | |
| 4,646,517 | A | 3/1987 | Wright | |
| 4,745,969 | A | 5/1988 | Henderson | |
| 4,991,650 | A | 2/1991 | McLeod | |
| 6,598,680 | B2 * | 7/2003 | DeBerry | 166/368 |
| 6,854,515 | B2 | 2/2005 | Matthews et al. | |
| 2006/0222525 | A1 | 10/2006 | Lacusta et al. | |

FOREIGN PATENT DOCUMENTS

| | | |
|---|---|---|
| CA | 2415446 | 8/2005 |
| CA | 2490846 | 12/2006 |

* cited by examiner

*Primary Examiner*—David J Bagnell
*Assistant Examiner*—Elizabeth C Gottlieb
(74) *Attorney, Agent, or Firm*—Greenlee Winner and Sullivan PC

(57) ABSTRACT

A wellhead assembly to seal and suspend an in-casing hydraulic drive unit for a downhole pump, including pressure-containing wellhead body members with a vertical bore and a production bore at its uppermost portion. A hydraulic pump hanger is retained and sealed in the vertical bore. The hydraulic pump hanger suspends and seals the hydraulic cylinder, includes a bore extending vertically therethrough, forms at least one hydraulic line to communicate with hydraulic fluid supply lines, forms a hydraulic inlet port to each hydraulic line, and provides a check valve sealed in each hydraulic inlet port. The wellhead body member(s) includes a stem port aligned with each hydraulic inlet port, with a valve actuating stem sealed in each stem port to actuate each check valve between a normally closed and open position. The wellhead body member(s) also includes hydraulic injection port(s) formed to supply hydraulic fluid to each hydraulic inlet port.

17 Claims, 5 Drawing Sheets

WELLHEAD ASSEMBLY FOR HYDRAULIC PUMPING SYSTEM

CROSS-REFERENCE TO RELATED APPLICATIONS

This application claims the benefit of U.S. Provisional Application 60/757,833, filed Jan. 9, 2006 and U.S. Provisional Application 60/804,521, filed Jun. 12, 2006. Both applications are incorporated herein in their entirety to the extent not inconsistent herewith.

BACKGROUND OF THE INVENTION

This invention relates to a wellhead assembly for use with an in-casing hydraulic drive unit for a hydraulic pumping system.

Pumping of oil from oil wells having insufficient pressure to produce by natural means is commonly practiced using what is termed a "pump jack". This device operates at the well surface to reciprocate a sucker rod extending downwardly into the well casing and which has connected at its downhole end to a downhole well pump. Reciprocating the sucker rod actuates the downhole pump and results in an upward pumping of the oil through the well casing.

In some wells, it is advantageous to use a hydraulic pumping unit to drive the downhole pump instead of the pump jack, one major advantage being the elimination of the stuffing box which seals the reciprocating sucker rod. Hydraulically operated pumping systems are also known in the prior art. Most of these systems utilize above ground hydraulic drive equipment, see for example, U.S. Pat. No. 4,646,517, issued Mar. 3, 1987 to Wright and U.S. Pat. No. 4,305,461, issued Dec. 15, 1981 to Meyer. More recently, an "in-casing" hydraulic drive unit has been proposed, wherein the hydraulic drive unit is contained within the casing of the oil well, below the wellhead assembly. Patent literature disclosing such systems include U.S. Pat. No. 6,854,515 issued Feb. 15, 2005 to Matthew et al., CA Patent 2,415,446 to Matthews et al., issued Aug. 23, 2005, U.S. Patent Application No. 2006/0222525 A1, by Lacusta et al., published Oct. 5, 2006, CA Patent 2,490,846 issued Dec. 19, 2006 to Sabre Machining Ltd., and U.S. Pat. No. 4,745,969 issued May 24, 1988 to Henderson. However, these "in-casing" systems do not disclose wellhead assemblies for adequate wellhead control and/or control over the hydraulic supply lines with isolation from the production.

A wellhead assembly is needed for use with in-casing hydraulic pumping systems in order to provide for adequate well control. For example, in U.S. Pat. No. 6,854,515, the wellhead control is described only in passing, noting that a landing spool is bolted onto the wellhead and the hanger of the wellhead hydraulic drive unit will then be landed within the landing spool. Alternatively, in U.S. Pat. No. 6,854,515, it is noted that the wellhead hydraulic drive unit can be directly bolted to the wellhead by means of a flange where well control precautions are not an issue. Neither wellhead control approach is shown in the patent. Thus, there is a need for a wellhead assembly to provide adequate well control for use with a hydraulic pumping unit. Such well control is often needed in environments with tight regulatory controls on emissions.

SUMMARY OF THE INVENTION

In accordance with one broad aspect, the present invention provides a wellhead assembly to seal and suspend an in-casing hydraulic drive unit for a downhole pump, the hydraulic drive unit being of a type having a hydraulic cylinder, a driven element within the hydraulic cylinder, and one or more hydraulic fluid supply lines providing hydraulic fluid to drive the driven element, the wellhead assembly including:

a) one or more pressure-containing wellhead body members forming a vertical bore extending therethrough and forming a production bore at an uppermost portion of the vertical bore;

b) a hydraulic pump hanger retained and sealed within the vertical bore of the one or more wellhead body members, the hydraulic pump hanger being operative to:
   i) suspend and seal from its lower end the hydraulic cylinder of the hydraulic drive unit;
   ii) form a bore extending vertically therethrough and communicating with the production bore;
   iii) form at least one hydraulic line to communicate with the one or more hydraulic fluid supply lines of the hydraulic drive unit;
   iv) form a hydraulic inlet port communicating with each hydraulic line; and
   v) provide a check valve sealed in each hydraulic inlet port;

c) a stem port formed in the one or more wellhead body members and aligned to communicate with each hydraulic inlet port;

d) a valve actuating stem sealed in each stem port to actuate each check valve between a normally closed position and an open position; and e) at least one hydraulic injection port formed through the wall of the one or more wellhead body members to supply hydraulic fluid to one or more of the hydraulic inlet ports.

In one embodiment, the wellhead assembly of this invention includes a hydraulic pump hanger formed in multiple parts such that a part forming the hydraulic inlet port can be rotated, aligned and positionally retained relative to the one or more wellhead body members to align the hydraulic inlet port with the stem port formed in the one or more body members.

In another embodiment, the wellhead assembly has the bore of the hydraulic pump hanger formed at its upper end with a profile to receive a pressure barrier.

In yet another embodiment, the wellhead assembly further includes:

a) the one or more wellhead body members forming a separate tubing head, and a separate tubing head adapter mounted and sealed above the tubing head; and b) the hydraulic pump hanger sealing the vertical bore through each of the tubing head and the tubing head adapter. In a more preferred embodiment, the stem port is formed in the tubing head adapter, and the hydraulic pump hanger is located at least partially within the tubing hanger adapter such that each hydraulic line, hydraulic inlet port and check valve is located to align with the stem port in the tubing head adapter, such that the tubing head adapter may be removed from the tubing head with each hydraulic line in a secure, closed position.

In another embodiment, the hydraulic pump hanger further includes a tubing hanger retained and sealed in the vertical bore of the one or more wellhead body members to suspend and seal an outer receiver barrel for the hydraulic cylinder of the hydraulic drive unit.

In yet another embodiment, the hydraulic pump hanger is formed in multiple parts to include:

a) a hydraulic cylinder hanger to seal and suspend the hydraulic cylinder in the vertical bore of the tubing head;

b) an injection gland above the hydraulic cylinder hanger, the injection gland being retained and sealed in the vertical bore of the tubing head adapter, the injection gland forming the hydraulic inlet port communicating with each hydraulic line, and providing the check valve sealed in each hydraulic inlet port; and c) a hydraulic line assembly held within the hydraulic cylinder hanger and the injection gland, the hydraulic line assembly providing or forming:
   i) a connection at its lower end to the hydraulic cylinder of the hydraulic drive unit, the hydraulic line assembly;
   ii) a circumferential seal at its upper end to seal the vertical bore of the tubing head adapter;
   iii) the bore extending vertically therethrough and communicating with the production bore;
   iv) the hydraulic line to communicate with each of the one or more hydraulic fluid supply lines of the hydraulic drive unit, and
   v) an inner circumferential seal above and below each hydraulic inlet port to seal within the injection gland.

As used herein, "comprising" is synonymous with "including," "containing," or "characterized by," and is inclusive or open-ended and does not exclude additional, unrecited elements or method steps. The invention illustratively described herein suitably may be practiced in the absence of any element or elements, limitation or limitations which is not specifically disclosed herein.

The use of the indefinite article "a" in the claims before an element means that one of the elements is specified, but does not specifically exclude others of the elements being present, unless the context clearly requires that there be one and only one of the elements.

As used herein and in the claims, a reference to "connection", "connected" or "connect(s)" is a reference to a sealed pressure-containing connection unless the context otherwise requires.

By the term "pressure barrier", as used herein and in the claims, is meant a check valve, back pressure valve or plug which protects equipment and devices located thereabove against downhole pressure.

DETAILED DESCRIPTION OF THE INVENTION

Figure 1:
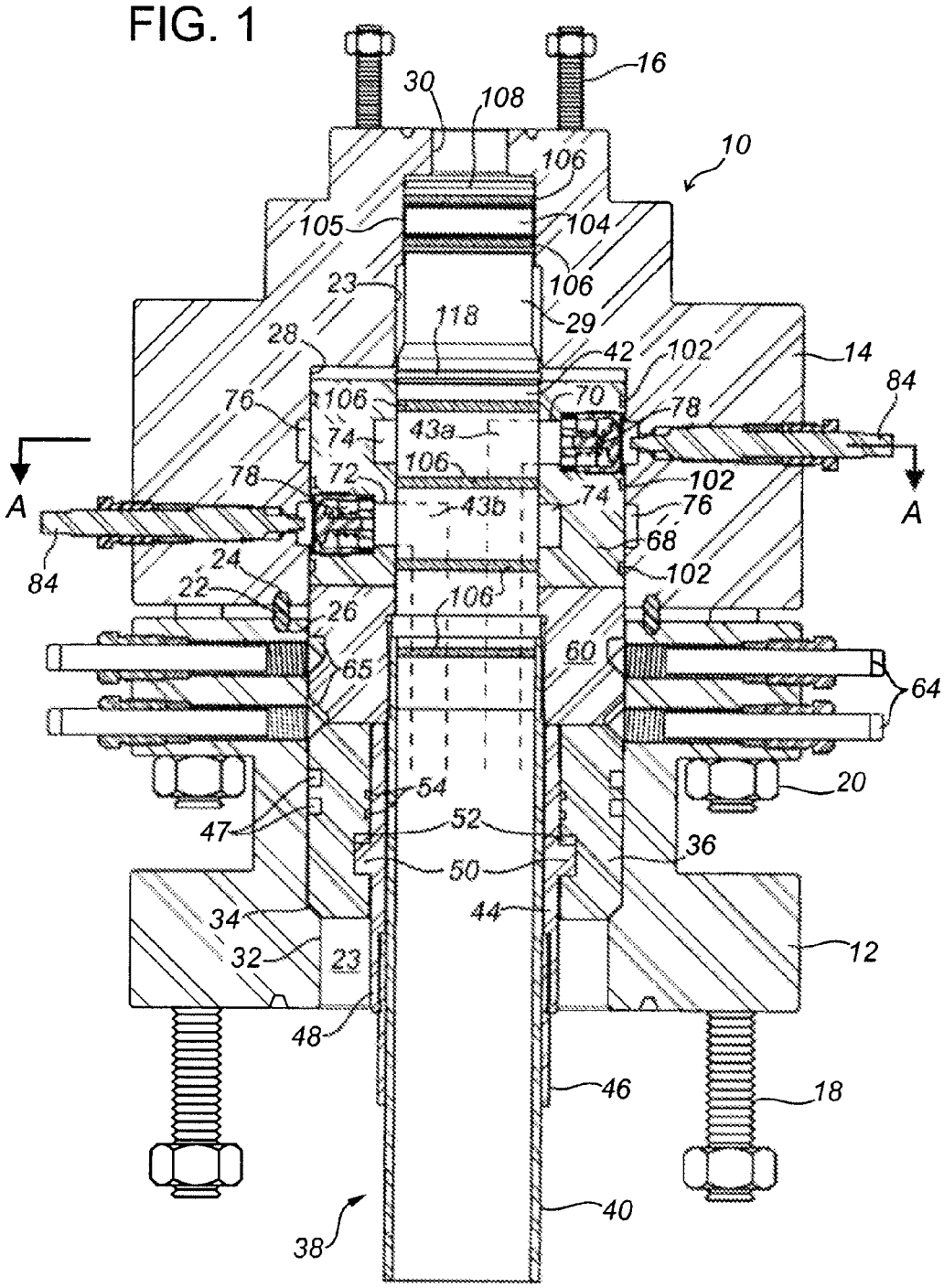
FIG. 1 is a side sectional view of the wellhead assembly of the present invention, providing well control and hydraulic fluid supply to an in-casing hydraulic drive unit of a hydraulic pumping unit, shown partially in section.

In order to illustrate the wellhead assembly 10 of the present invention, it is shown connected to, and suspending, certain components of an in-casing hydraulic drive unit, which may form part of the prior art. The wellhead assembly 10 may be modified from that shown in the figures, as needed to connect to different configurations of prior art hydraulic drive units.

At the outset it should be understood that the hydraulic drive unit shown generally at 38 with the preferred embodiment of the wellhead assembly 10 of this invention is somewhat modified from that shown in the prior art, see for example U.S. Pat. No. 6,854,515. In that patent the hydraulic drive unit is shown to include a hydraulic cylinder which houses a piston/ram assembly operative to stroke the production tubing itself, although it is noted as being adaptable to stroke the sucker rod as well. The hydraulic cylinder of U.S. Pat. No. 6,854,515 is generally analogous to the hydraulic cylinder (sometimes termed stroker outer barrel) shown in the embodiments of the present invention. The prior art in-casing hydraulic drive units to which the wellhead assembly of this invention is designed to operate will generally include a hydraulic cylinder (labeled 40 in the figures of this invention), which houses therein a reciprocating hydraulic piston (not shown in figures of this invention), and one or more hydraulic fluid supply lines (shown as 110 in FIG. 5) which drive the piston. If the hydraulic piston is to be driven in both the upward and downward stroking direction, there are typically two hydraulic fluid supply lines to drive the piston from above and below. Thus, in the preferred embodiments shown for the present invention, provision for connection to two hydraulic fluid supply lines are shown. However, a single supply line may also be provided through the wellhead assembly 10.

It should be understood that an in-casing hydraulic drive unit for use with the present invention may not include a reciprocating piston, as above-described. It could, for example, include a hydraulically driven rotary member within a hydraulic cylinder. Thus, "in-casing hydraulic drive unit", as used herein and in the claims is meant to refer to any hydraulically controlled in-casing drive unit for a downhole pump. Such drive units will be of a type having an in-casing hydraulic cylinder, a driven element within the hydraulic cylinder, and hydraulic fluid supply lines to driven the driven element.

In U.S. Pat. No. 6,854,515, the hydraulic cylinder is housed in an outer receiver barrel (sometime referred to as the stroker receiver barrel). In preferred embodiments of the present invention, provision is made to suspend this outer receiver barrel (labeled 46) from the wellhead assembly 10. Only the upper end of the hydraulic drive unit 38 is shown in the Figures, this being the portion contained within the wellhead assembly 10 of the present invention. In general, the production tubing (not shown) is suspended from either the outer receiver barrel (if present) or the hydraulic cylinder of the hydraulic drive unit.

Having reference to FIG. 1, the wellhead assembly 10 includes one or more pressure-containing wellhead body members, shown to preferably include a tubing head 12 and a tubing head adapter 14 which are sealed together to contain the inner components, which in turn seal and suspend the hydraulic drive unit 38 (as shown herein, or as modified as known in the art). The upper end of the tubing head adapter 14 provides top connectors (shown as studded up connectors) 16, while the lower end of the tubing head 12 provides bottom connectors (shown as studded down connectors) 18, for connecting the wellhead assembly 10 to conventional wellhead equipment (not shown) located above and below. The tubing head 12 and tubing head adapter 14 are bolted together with bolts 20, and are sealed together for well control, preferably with a metal seal ring or ring gasket 22 located in aligned circumferential grooves 24, 26 in the tubing head adapter 14 and tubing head 12 respectively. The tubing head 12 and tubing head adapter 14 are formed with a vertical bore 23 extending therethrough, which in FIG. 1 is preferably shown to form a central chamber 28 (in both the tubing head 12 and tubing head adapter 14) which is generally cylindrical and enlarged relative to the diameter of the vertical production bore 30 of the wellhead assembly, shown at the upper end of the tubing head adapter 14.

A hydraulic pump hanger 29 is retained and sealed in the vertical bore 23 of the tubing head 12 and tubing head adapter 14 in order to suspend and seal the hydraulic cylinder 40 (and the outer receiver barrel 46 if present) of the hydraulic drive unit 38. The hydraulic pump hanger 29 is formed with a bore 31 extending vertically therethrough, and communicating with the production bore 30 of the tubing head adapter 14. As described in greater detail below, the hydraulic pump hanger 29 also forms or houses hydraulic lines 43*a*, 43*b* to connect to the hydraulic supply lines 110 of the hydraulic drive unit 38. The hydraulic pump hanger 29 also provides isolation for each of the hydraulic lines 43*a*, 43*b*, for example by check valves 78 actuated from outside the wellhead assembly 10, in a manner to allow the tubing head adapter 14 to be removed while isolating the hydraulic lines 43*a*, 43*b*. Finally, the hydraulic pump hanger 29 preferably provides total isolation of the production fluids moving into the production bore 30, from the hydraulic fluid moving through the hydraulic lines 43*a*, 43*b*. The hydraulic pump hanger 29 is shown in the figures to be formed as multiple body components, however, it should be appreciated that the pump hanger 29 could be formed as a single or multiple body unit, within the scope of the present invention.

In the event that the hydraulic drive unit 38 includes an outer receiver barrel 46, as indicated above, the hydraulic pump hanger 29 provides for suspending and sealing of that barrel 46. To that end, the lower end 32 of the central chamber 28 preferably forms an inwardly projecting landing shoulder 34 for landing a tubing hanger component 36. Alternatives to this landing shoulder may be used as known in the art, for instance, a run-in landing shoulder or tubing hanger profile, or tubing hanger support pins extending through the tubing head 12.

Figure 3:
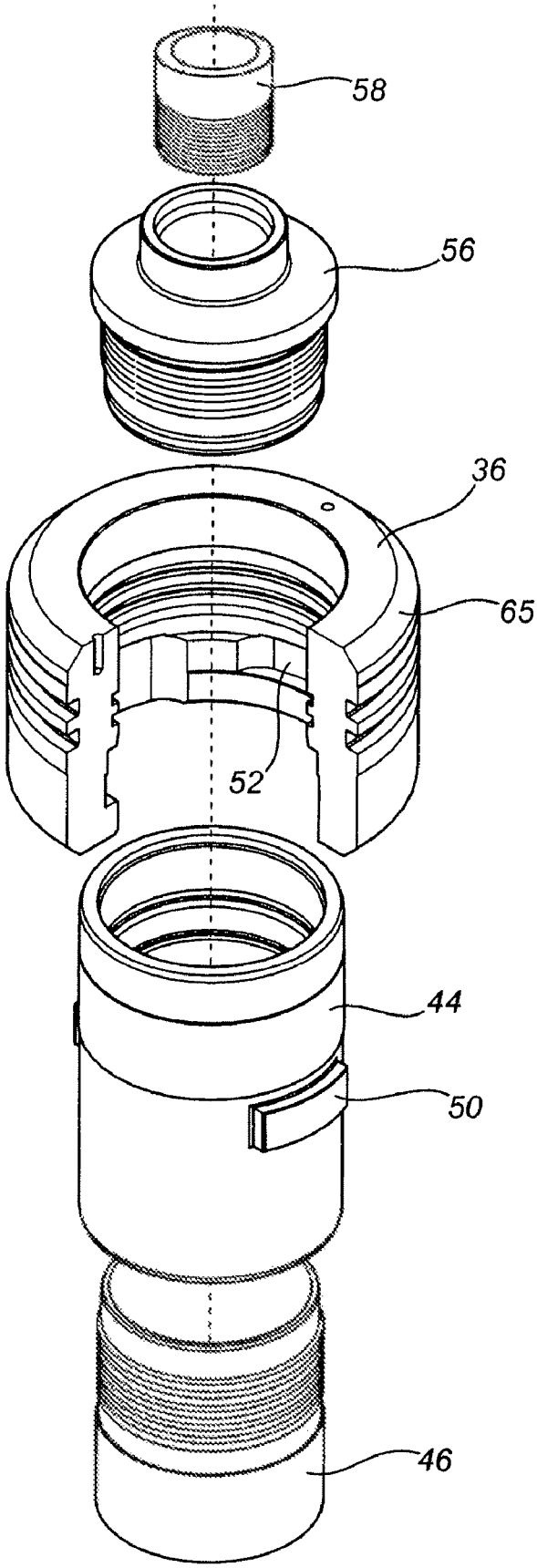
FIG. 3 is an exploded perspective view of the tubing hanger component of the the wellhead assembly of this invention, from which an outer receiver barrel of a prior art hydraulic drive unit is suspended.

In FIG. 1, the tubing hanger 36 is shown to include a tubing hanger inner bushing 44 suspended and sealed within the tubing hanger 36, and the outer receiver barrel 46 is connected by threaded connection at the lower end 48 of the inner bushing 44. The production tubing itself (not shown) is typically suspended from the lower end (not shown) of the outer receiver barrel 46. The hydraulic cylinder 40 of the hydraulic drive unit in turn is held within the outer receiver barrel 46. The tubing hanger 36 includes one or more outer circumferential seal rings 47 to seal to the wall of the central chamber 28 of the wellhead assembly 10. The inner bushing 44 is formed with protruding locking lugs 50, which mate with matching slots 52 formed in the inner wall of the tubing hanger 36 (best shown in FIG. 3) in order to suspend the bushing 44 within the tubing hanger 36. Circumferential seals 54 are carried on the inner wall of the tubing hanger 36 in order to seal to the inner bushing 44. FIG. 3 also shows the threaded running tool 56 and threaded landing joint 58 used to land the tubing hanger component 36, as is known in the art. It will be appreciated that the tubing hanger 36 may be modified as known in the art, for example, the bushing 44 may be formed integral with the tubing hanger 36.

In order to suspend the hydraulic cylinder 40 of the hydraulic drive unit, the hydraulic pump hanger 29 preferably includes a separate hydraulic cylinder hanger 60, located in the central chamber 28 above the tubing hanger 36. The hanger 60 is preferably threaded at its lower end 62 to connect to and receive the threaded upper end of the outer barrel 40, although alternate connections may be used as known in the art. In FIG. 1, each of the tubing hanger 36 and hydraulic cylinder hanger 60 is shown to be retained by a plurality of lock down pins 64, received within circumferential retention grooves 65 formed on the outer walls of each of the tubing hanger 36 and hydraulic cylinder hanger 60.

In FIG. 1, the hydraulic pump hanger 29 is shown to preferably include two further body components located above the tubing hanger 36 and the hydraulic cylinder hanger 60, namely an inner hydraulic line assembly 42 and an outer injection gland 68. Whereas the hangers 36, 60 are preferably largely contained and sealed within the vertical bore 23 of the tubing head 12, the injection gland 68 and hydraulic line assembly 42 are both preferably largely contained and sealed within the vertical bore 23 of the tubing head adapter 14. The injection gland 68 and the hydraulic line assembly 42 preferably maintain control and isolation of the hydraulic lines 43*a*, 43*b* from the production bore 30, and provide isolation and control of the hydraulic lines 43*a*, 43*b* when the tubing head adapter 14 is removed.

Figure 5:
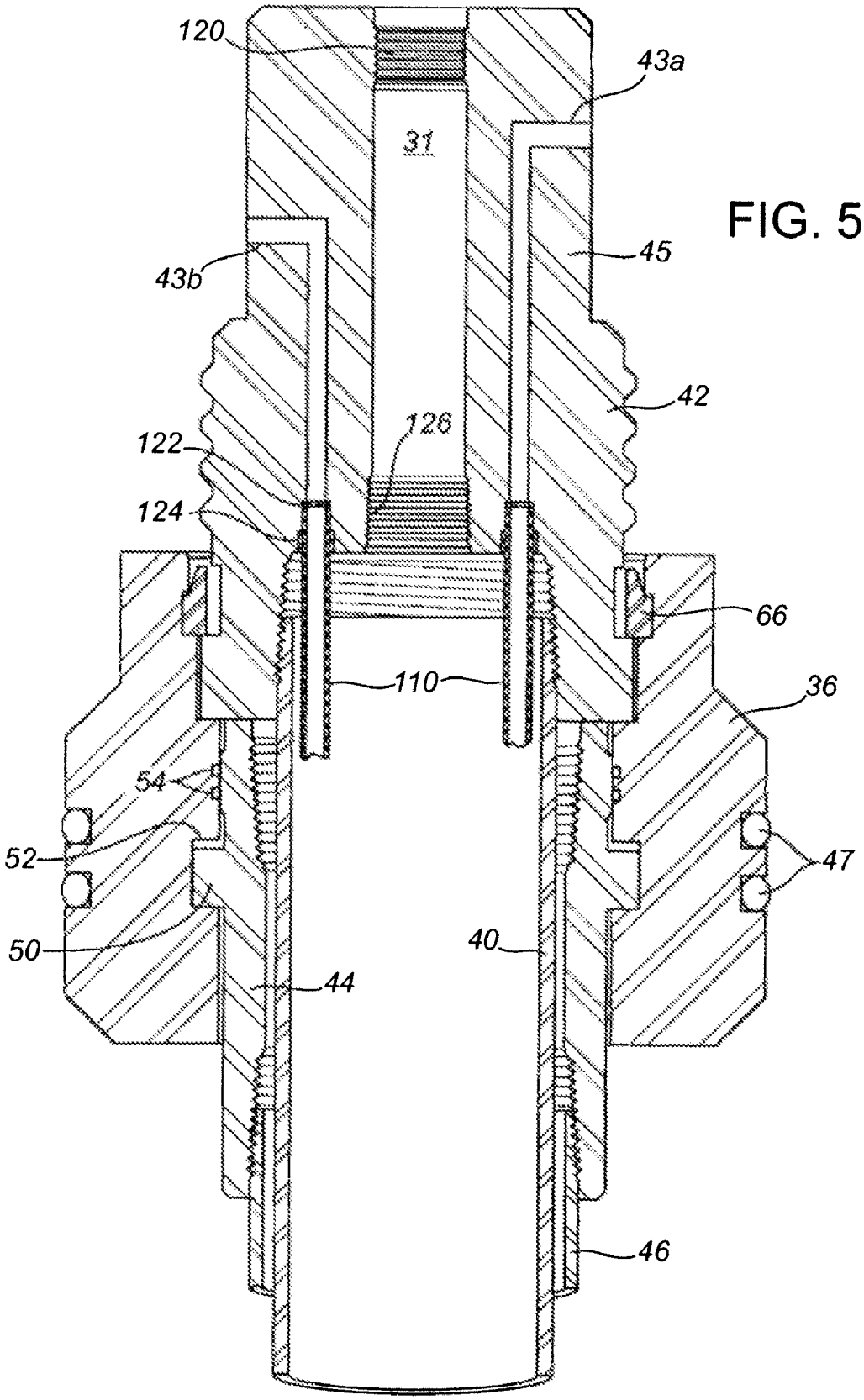
FIG. 5 is a side sectional view of a second embodiment of the wellhead assembly of this invention, in which a snap ring connection is provided between the tubing hanger and the hydraulic line assembly components, thus eliminating the upper set of hanger lockdown pins from the embodiment of FIG. 1.

The hydraulic line assembly 42 extends upwardly into the tubing head adapter 14 and preferably seals at its upper end to the production bore 30 of the tubing head adapter. The lower end of the hydraulic line assembly 42 is preferably connected to, for example by threads, to the upper end of the hydraulic cylinder 40. The hydraulic line assembly 42 includes upper and lower hydraulic lines or ports 43*a*, 43*b*, as shown in FIGS. 1 and 5, formed in the wall 45 of the hydraulic line assembly 42. The wall 45 forms the production bore 31 which is an extension of the production bore 30. The hydraulic lines 43*a*, 43*b* supply hydraulic fluid to drive the stroker piston (not shown) of the hydraulic drive unit 38, which is generally operative to reciprocate in the hydraulic cylinder 40.

The injection gland component 68 is shown in FIG. 1 to be sealed in the central chamber 28 of the tubing head adapter above the hanger 60. This injection gland component 68 provides for sealed hydraulic connections through the tubing head adapter 14 to the hydraulic lines 43*a*, 43*b* of the hydraulic line assembly 42. The hydraulic lines 43*a*, 43*b* (upper and lower) are preferably staggered relative to each other, both vertically and radially. Each of these lines 43a and 43*b* communicates with a hydraulic inlet port 70 or 72 (upper and lower), formed through the wall of the injection gland 68. These inlet ports 70, 72 in turn preferably communicate with inner and outer circumferential recess grooves 74, 76 formed respectively in the inner wall of the injection gland 68 and the vertical bore 23 of the tubing head adapter 14. Within each of the ports 70, 72 is located a check valve 78 to control hydraulic fluid flow through to the hydraulic lines 43a and 43b. Upper and lower hydraulic injection ports 80,82 are formed through the wall of the tubing head adapter 14 to the outer recess grooves 76 formed in the tubing head adapter 14 in order to supply hydraulic fluid to the lines 43*a*, 43*b*. The sizing of the hydraulic injection ports 80, 82 and the grooves 74, 76 will determine the flow rate for the hydraulic fluid.

Figure 4:
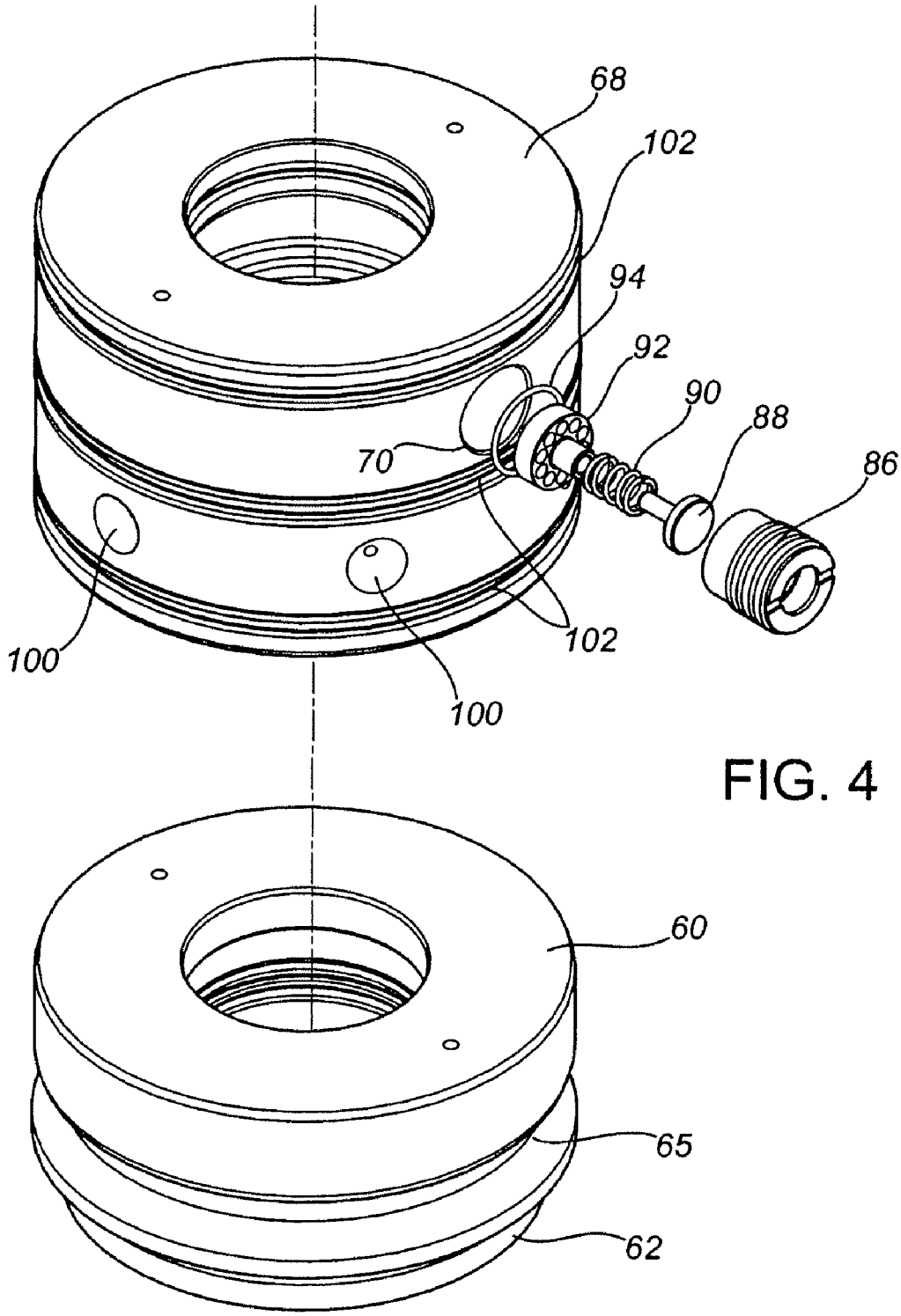
FIG. 4 is a perspective view of the injection gland and hydraulic cylinder hanger components of the wellhead assembly of this invention.

The inlet ports 70, 72, and thus the check valves 78, are each aligned with the valve actuating stems 84 extending through the tubing head adapter 14 to open and close the valves 78. One example of a suitable check valve 78 is shown in FIG. 4. The valve parts include check valve housing 86 (threaded into the inlet ports 70, 72 of the injection gland 68), check valve poppet 88, spring 90, check valve body 92 and check valve ring seal 94. Other flow control plugs or check valve designs may be used as known in the art. The valves 78 are actuated by the valve actuating stems 84 which are threaded and sealed within stem ports 96 formed in the wall of the tubing head adapter 14. In order to align the actuating stems 84 and the check valves 78, the injection gland 68 can preferably be rotated after landing to align alignment/retention lockdown pins 98 extending in sealed relationship through the wall of the tubing head adapter 14, with alignment and retention dimples 100 formed in the outer wall of the injection gland 68. This in turn aligns the inlet ports 70, 72 (and thus the check valves 78) in the injection gland 68 with the stem ports 96 and stems 84 of the tubing head adapter 14.

Figure 2:
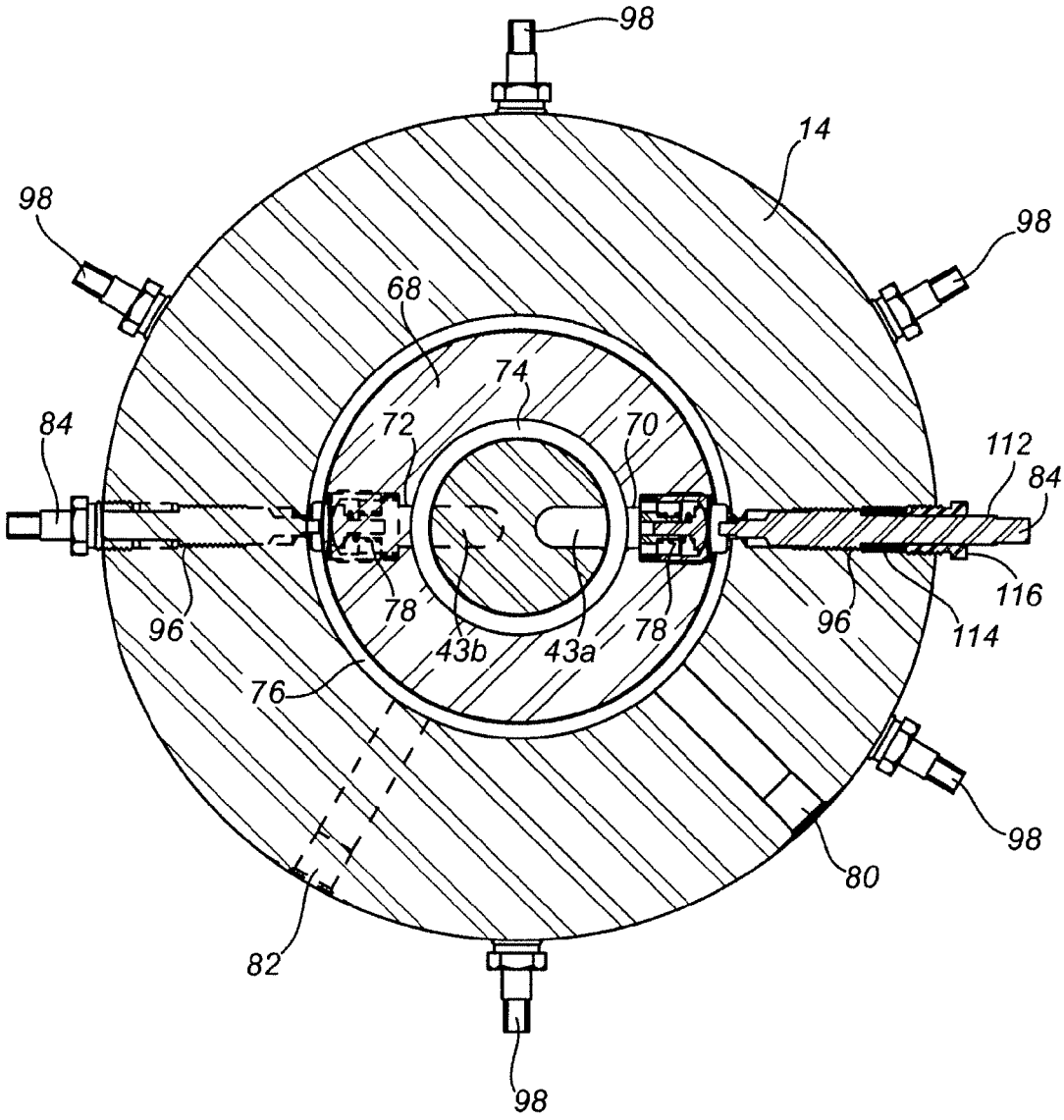
FIG. 2 is a cross-sectional view of the wellhead assembly, taken along line A in FIG. 1.

One preferred embodiment of the valve actuating stems 84 is shown in FIG. 2 to include a threaded stem 112 to move in threaded stem ports 96, packing seals 114 to seal the stem 112 in the ports 96, and a gland nut 116 threaded into the stem ports 96 at the outer end of the stem 112. As the stem 112 is threaded into the stem port 96, the stem contacts the spring actuated, normally closed check valve 78, to move it to an open position whereby hydraulic fluid may flow into the hydraulic lines 43*a*, 43*b*. Alternate embodiments for sealing a valve actuator into the tubing head adapter 14 may be used, as known in the art. As well, it should be understood that the term "valve actuating stem", as used herein and in the claims, is not limited to the threaded stem embodiment as shown. Rather, the term is meant to include other mechanically actuated or driven shafts, including without limitation, hydraulic, pneumatic or cam driven shafts.

The injection gland 68 carries circumferential ring seals 102 located above and below each of the outer recess grooves 76 in the tubing head adapter 14 for sealing against the wall of the central chamber 28 (and thus the vertical bore 23) of the tubing head adapter 14, in order to seal the vertical bore 23.

The hydraulic line assembly 42 includes an extended neck portion 104 which extends upwardly through the injection gland 68 in the tubing head adapter 14. The adapter 14 includes a smaller diameter central bore section 105 at its upper end to seal with this extended neck portion 104. A snap ring 118 fastened to the extended neck portion 104, just above the injection gland 68, retains these two components.

As shown in FIG. 1, the hydraulic line assembly 42 includes multiple ring seals 106 to seal to each of the tubing head adapter 14, the injection gland 68 (above and below inner recess grooves 74) and the hydraulic cylinder hanger 60. These seals 106 could alternatively be carried on the wellhead assembly components themselves. As well, the upper end 108 of the extended neck portion 104 preferably includes an inner thread 120 (see FIG. 5) to receive a pressure barrier such as a back pressure valve (not shown).

FIG. 5 shows alternate and/or additional features of the hydraulic line assembly 42, which may vary depending on the particular hydraulic drive unit 38 parts to which the wellhead assembly 10 is to be connected, sealed, suspended or contained. A snap ring connector 66 may be held within the upper end of the tubing hanger 36, for connection directly with the hydraulic line assembly 42, eliminating the need for the upper set of locking pins 64 shown in FIG. 1. The hydraulic lines 43*a*, 43*b* are shown with one type of sealed connection to hydraulic fluid supply lines 110 of a particular hydraulic drive unit 38. As shown, the outlets 122 of lines 43*a*, 43*b* are stepped to retain seals 124 in tight fitting relationship around the hydraulic supply lines 110. Also shown at the lower end of the production bore 31 of the hydraulic line assembly 42 is an inner thread 126 which may be used to connect to a production tube (not shown) of a hydraulic drive unit 38 (for instance, in U.S. Pat. No. 6,854,515, a production tube labeled as item 68 functions as a stationary part of the hydraulic pump through which the production flows).

It will be appreciated that the wellhead assembly 10 of this invention, formed with separate wellhead body members of a tubing head and tubing head adapter, together with valve control in the hydraulic lines of the hydraulic pumping hanger 29, allows for the tubing head adapter 14 to be lifted off the tubing head 12, leaving the hydraulic lines secure and closed by the check valves 78.

Although the one or more wellhead body members are shown with flange connections top and bottom, other connections are possible, as known in the art. The bottom connector to the outer receiver barrel 46 is shown as a threaded connection, but it may include a welded connection or other connections known in the art. The top connectors of the uppermost wellhead member may include a threaded, flange or clamp connection, as appropriate to connect to the production or service equipment (not shown).

All publications mentioned in this specification are indicative of the level of skill in the art of this invention. All publications are herein incorporated by reference to the same extent as if each publication was specifically and individually indicated to be incorporated by reference.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by the preferred embodiments and optional features, modification and variation of the concepts herein disclosed may be resorted to by those skilled in the art, and that such modifications and variations are considered to be within the scope of this invention as defined by the appended claims.

We claim:

1. A wellhead assembly to seal and suspend an in-casing hydraulic drive unit for a downhole pump, the hydraulic drive unit being of a type having a hydraulic cylinder, a driven element within the hydraulic cylinder, and one or more hydraulic fluid supply lines providing hydraulic fluid to drive the driven element, the wellhead assembly comprising:

a) one or more pressure-containing wellhead body members forming a vertical bore extending therethrough and forming a production bore at an uppermost portion of the vertical bore;

b) a hydraulic pump hanger retained and sealed within the vertical bore of the one or more wellhead body members, the hydraulic pump hanger comprising:

i) a lower end configured to suspend and seal the hydraulic cylinder of the hydraulic drive unit;

ii) a bore extending vertically therethrough and communicating with the production bore;

iii) at least one hydraulic line to communicate with the one or more hydraulic fluid supply lines of the hydraulic drive unit;

iv) a hydraulic inlet port communicating with each hydraulic line; and v) a check valve sealed in each hydraulic inlet port;

c) a stem port formed in the one or more wellhead body members and aligned to communicate with each hydraulic inlet port;

d) a valve actuating stem sealed in each stem port to actuate each check valve between a normally closed position and an open position to open and close each check valve; and e) at least one hydraulic injection port formed through the wall of the one or more wellhead body members to supply hydraulic fluid to one or more of the hydraulic inlet ports.

2. The wellhead assembly of claim 1, wherein the hydraulic pump hanger is formed in multiple parts such that a part forming the hydraulic inlet port can be rotated, aligned and positionally retained relative to the one or more wellhead body members to align the hydraulic inlet port with the stem port formed in the one or more body members.

3. The wellhead assembly of claim 1, wherein the bore of the hydraulic pump hanger is formed at its upper end with a profile to receive a pressure barrier.

4. The wellhead assembly of claim 2, wherein:

the one or more wellhead body members include a tubing head and a tubing head adapter mounted and sealed above the tubing head; and the hydraulic pump hanger seals the vertical bore through each of the tubing head and the tubing head adapter.

5. The wellhead assembly of claim 4, wherein:

the stem port is formed in the tubing head adapter; and the hydraulic pump hanger is located at least partially within the tubing hanger adapter such that each hydraulic line, hydraulic inlet port and check valve is located to align with the stem port in the tubing head adapter, such that the tubing head adapter may be removed from the tubing head with each hydraulic line in a secure, closed position.

6. The wellhead assembly of claim 5, wherein the hydraulic pump hanger comprises:

a hydraulic cylinder hanger to seal and suspend the hydraulic cylinder in the vertical bore of the tubing head;

an injection gland above the hydraulic cylinder hanger, the injection gland being retained and sealed in the vertical bore of the tubing head adapter, the injection gland forming the hydraulic inlet port communicating with each hydraulic line, and providing the check valve sealed in each hydraulic inlet port; and a hydraulic line assembly held within the hydraulic cylinder hanger and the injection gland, the hydraulic line assembly providing or forming:

i) a connection at its lower end to the hydraulic cylinder of the hydraulic drive unit, the hydraulic line assembly;

ii) a circumferential seal at its upper end to seal the vertical bore of the tubing head adapter;

iii) the bore extending vertically therethrough and communicating with the production bore;

iv) the hydraulic line to communicate with each of the one or more hydraulic fluid supply lines of the hydraulic drive unit, and v) an inner circumferential seal above and below each hydraulic inlet port to seal within the injection gland.

7. The wellhead assembly of claim 6, which further comprises:

inner and outer circumferential recess grooves formed in an inner wall of the injection gland and an inner wall of the tubing head adapter respectively at locations to communicate with one or more of the hydraulic inlet ports;

at least one circumferential ring seal on the injection gland located above and below the outer recess grooves to seal the vertical bore of the tubing head adapter; and one or more of the inner circumferential ring seals on the hydraulic line assembly being located above and below the inner recess grooves to seal to the injection gland.

8. The wellhead assembly of claim 6, wherein the hydraulic drive unit is of the type having two hydraulic fluid supply lines to provide hydraulic fluid to the driven element, and wherein the wellhead assembly further comprises:

the hydraulic line assembly forming two hydraulic lines, one to communicate with each of the hydraulic fluid supply lines;

the injection gland forming an upper and a lower hydraulic inlet port in order to communicate with each of the hydraulic lines;

inner and outer circumferential recess grooves formed in an inner wall of the injection gland and an inner wall of the tubing head adapter respectively at locations to communicate with the upper and lower hydraulic inlet ports;

two hydraulic injection ports formed through the wall of the tubing head adapter to communicate with the outer recess grooves to supply hydraulic fluid to the upper and lower hydraulic inlet ports;

at least one outer circumferential ring seals on the injection gland located above and below the outer recess grooves to seal the vertical bore of the tubing head adapter; and one or more of the inner circumferential ring seals on the hydraulic line assembly being located above and below the inner recess grooves to seal to the injection gland.

9. The wellhead assembly of claim 8, wherein the injection gland can be rotated, aligned and positionally retained relative to the tubing head adapter to align the hydraulic inlet ports with the stem ports formed in the tubing head adapter.

10. The wellhead assembly of claim 9, wherein the hydraulic line assembly is formed with a profile at an upper end to receive a back pressure valve.

11. The wellhead assembly of claim 1, wherein the hydraulic pump hanger further comprises a tubing hanger retained and sealed in the vertical bore of the one or more wellhead body members to suspend and seal an outer receiver barrel for the hydraulic cylinder of the hydraulic drive unit.

12. The wellhead assembly of claim 10, further comprising a tubing hanger retained and sealed in the vertical bore of the tubing head below the hydraulic cylinder hanger, the tubing hanger being operative to suspend and seal an outer receiver barrel for the hydraulic cylinder of the hydraulic drive unit.

13. The wellhead assembly of claim 12, wherein the tubing hanger comprises:

an outer housing adapted to land on a landing shoulder formed in the tubing head, one or more outer circumferential seals carried on the outer housing to seal to the vertical bore, one or more slots or grooves formed in the inner wall of the outer housing;

an inner bushing suspended within the outer housing by one or more protruding locking lugs with mate with the one or more slots or grooves of the outer housing, and including a threaded portion to thread to mating threads on the outer receiver barrel, and one or more circumferential seals between the inner bushing and outer housing to seal the inner bushing within the outer housing; and one or more retaining pins extending through and sealing in the tubing head to retain the tubing hanger.

14. The wellhead assembly of claim 13, wherein the hydraulic line assembly provides a threaded connection to the hydraulic cylinder of the hydraulic drive unit.

15. The wellhead assembly of claim 14, wherein the hydraulic cylinder is suspended by a threaded connection on the hydraulic cylinder hanger.

16. The wellhead assembly of claim 15, wherein the hydraulic cylinder hanger is retained by one or more retaining pins extending through and sealing in the tubing head.

17. The wellhead assembly of claim 15, wherein the tubing hanger is connected to the hydraulic line assembly with a snap ring.

* * * * *